US007165831B2

(12) United States Patent
Cornell et al.

(10) Patent No.: US 7,165,831 B2
(45) Date of Patent: Jan. 23, 2007

(54) MICRO-FLUID EJECTION DEVICES

(75) Inventors: Robert W. Cornell, Lexington, KY (US); Richard L. Goin, Lexington, KY (US); James H. Powers, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 237 days.

(21) Appl. No.: 10/921,657

(22) Filed: Aug. 19, 2004

(65) Prior Publication Data

US 2006/0038851 A1 Feb. 23, 2006

(51) Int. Cl.
*B41J 2/05* (2006.01)

(52) U.S. Cl. ..... 347/65; 347/47

(58) Field of Classification Search ..... 347/20, 347/56, 61–65, 67, 92–94, 43, 15
See application file for complete search history.

(56) References Cited

U.S. PATENT DOCUMENTS

| | | | | |
|---|---|---|---|---|
| 4,313,684 | A | 2/1982 | Tazaki et al. | 347/37 |
| 4,490,728 | A | 12/1984 | Vaught et al. | 347/56 |
| 4,694,308 | A | 9/1987 | Chan et al. | 347/65 |
| 5,278,584 | A | 1/1994 | Keefe et al. | 347/34 |
| 5,291,226 | A | 3/1994 | Schantz et al. | 347/63 |
| 5,442,384 | A | 8/1995 | Schantz et al. | 347/20 |
| 5,442,386 | A | 8/1995 | Childers et al. | 347/63 |
| 5,450,113 | A | 9/1995 | Childers et al. | 347/87 |
| 5,648,805 | A | 7/1997 | Keefe et al. | 347/65 |
| 5,736,998 | A | 4/1998 | Caren et al. | 347/45 |
| 5,852,460 | A | 12/1998 | Schaeffer et al. | 347/47 |
| 6,071,427 | A | 6/2000 | Raulinaitis | 347/50 |
| 6,120,131 | A | 9/2000 | Murthy et al. | 347/47 |
| 6,158,843 | A | 12/2000 | Murthy et al. | 347/47 |
| 6,267,468 | B1 * | 7/2001 | Torgerson et al. | 347/43 |
| 6,286,941 | B1 * | 9/2001 | Courian et al. | 347/65 |
| 6,322,200 | B1 | 11/2001 | Feinn et al. | 347/58 |
| 6,328,405 | B1 | 12/2001 | Weber et al. | |
| 6,364,455 | B1 | 4/2002 | Yang et al. | 347/47 |
| 6,387,719 | B1 | 5/2002 | Mrvos et al. | 438/21 |
| 6,513,896 | B1 | 2/2003 | Kawamura | |
| 2002/0054191 | A1 | 5/2002 | Moon et al. | 347/56 |

(Continued)

OTHER PUBLICATIONS

U.S. Appl. No. 10/694,679, Goin et al.

(Continued)

*Primary Examiner*—Juanita D. Stephens
(74) *Attorney, Agent, or Firm*—Luedeka, Neely & Graham

(57) ABSTRACT

A micro-fluid ejection head structure having multiple arrays of fluid ejection actuators. The structure includes a semiconductor substrate having a first array of fluid ejection actuators for ejecting a first fluid therefrom, and a second array of fluid ejection actuators for ejecting a second fluid therefrom. The first array of fluid ejection actuators is disposed in a first location on the substrate, and the second array of fluid ejection actuators is disposed in a second location on the substrate. A thick film layer having a thickness is attached adjacent the semiconductor substrate. The thick film layer has fluid flow channels formed therein solely for the first array of fluid ejection actuators. A nozzle plate is attached to the thick film layer opposite the semiconductor substrate. The nozzle plate has fluid flow channels formed therein for both the first array of fluid ejection actuators and the second array of fluid ejection actuators.

19 Claims, 9 Drawing Sheets

U.S. PATENT DOCUMENTS

| | | | | |
|---|---|---|---|---|
| 2002/0056698 | A1 | 5/2002 | Makigaki et al. | 216/27 |
| 2002/0093552 | A1 | 7/2002 | Yamamoto | 347/61 |
| 2002/0108243 | A1 | 8/2002 | Mou et al. | 29/890.1 |
| 2002/0113840 | A1 | 8/2002 | Trauernicht et al. | 347/47 |
| 2003/0038664 | A1 | 2/2003 | Mou et al. | 347/63 |
| 2003/0043237 | A1 | 3/2003 | Lin et al. | 347/68 |
| 2003/0085951 | A1 | 5/2003 | Keenan et al. | 347/47 |

OTHER PUBLICATIONS

U.S. Appl. No. 10/881,659, Goin et al.

* cited by examiner

MICRO-FLUID EJECTION DEVICES

FIELD OF THE INVENTION

The invention relates to micro-fluid ejection devices such as ink jet printheads and methods for making micro-fluid ejection devices having improved fluid flow characteristics.

BACKGROUND

A conventional micro-fluid ejection device such as an ink jet printhead generally has flow features either formed in a thick film layer deposited on a semiconductor substrate containing ink ejection devices or flow features ablated along with nozzle holes in a polymeric nozzle plate material. The term "flow features" is used to refer to fluid flow channels, fluid ejection chambers, and other physical features that provide a fluid such as ink to ejection devices on the semiconductor substrate. When both the nozzle holes and flow features are ablated in the nozzle plate material, a thick film material is typically not present. A disadvantage of forming the flow features and nozzle holes in the nozzle plate material is that the flow feature height and nozzle bore length are constrained by the nozzle plate material thickness. For micro-fluid ejection heads having a separate thick film layer and nozzle plate with the flow features formed in a thick film layer, the nozzle bore length is constrained to equal to the nozzle plate material thickness and the flow feature dimensions are determined by the thickness of the thick film layer.

With a trend toward increasing the functionality of micro-fluid ejection devices, it is desirable to provide fluid ejection devices on a single semiconductor substrate for ejecting different fluids having different drop masses. However, for largely disparate drop masses, the above constraints make the design of a single semiconductor substrate for multiple fluids difficult. For example, smaller droplet masses may be accommodated using flow features ablated in a nozzle plate material of a particular thickness. However, the larger droplet masses require additional flow features that cannot be ablated in a nozzle plate material suitable only for smaller drop masses. Alternatively, larger droplet masses may be accommodated using flow features formed in a thick film layer with nozzles ablated in a nozzle plate. However, the combined thickness of the thick film layer and nozzle plate degrades the ejection efficiency of the smaller droplet masses ejected from the same semiconductor substrate.

As the speed of micro-fluid ejection devices such as ink jet printers, increases the frequency of fluid ejection by individual ejection actuator elements must also increase requiring more rapid refilling of fluid ejection chambers. The requirement for more rapid refilling provides an incentive to devise a novel approach to providing flow features suitable for fluid ejection actuators for multiple size droplet masses on a single semiconductor substrate. Hence, there exists a need for improved micro-fluid ejection devices and methods for making the devices.

SUMMARY OF THE DISCLOSURE

With regard to the foregoing, the disclosure provides an improved micro-fluid ejection head structure having multiple arrays of fluid ejection actuators. The structure includes a semiconductor substrate having a first array of fluid ejection actuators for ejecting a first fluid therefrom, and a second array of fluid ejection actuators for ejecting a second fluid therefrom. The first array of fluid ejection actuators is disposed in a first location on the substrate, and the second array of fluid ejection actuators is disposed in a second location on the substrate. A thick film layer having a thickness is attached adjacent the semiconductor substrate. The thick film layer has fluid flow channels formed therein solely for the first array of fluid ejection actuators. A nozzle plate is attached to the thick film layer opposite the semiconductor substrate. The nozzle plate having fluid flow channels formed therein for both the first array of fluid ejection actuators and the second array of fluid ejection actuators.

In another embodiment, there is provided a method of making a micro-fluid ejection head structure. The method includes the steps of providing a semiconductor substrate and forming a first array of fluid ejection actuators for ejecting a first fluid therefrom in a first location on the semiconductor substrate. At least a second array of fluid ejection actuators for ejecting a second fluid therefrom is formed in a second location on the semiconductor substrate. A thick film layer is deposited with a thickness adjacent the first and second arrays of fluid ejection actuators on the semiconductor substrate. Fluid flow channels are formed in the thick film layer solely for the first array of fluid ejection actuators. A nozzle plate material is provided for attachment to the thick film layer. Fluid flow channels are formed in the nozzle plate material for both the first and second arrays of fluid ejection actuators. The nozzle plate is attached to the thick film layer opposite the semiconductor substrate to provide the micro-fluid ejection head structure.

An advantage of the embodiments described herein is that it enables independent variation of fluid flow characteristics for multiple arrays of fluid ejection actuators on a single substrate. Independent variation of fluid flow characteristics is provided by combining fluid flow channels formed in thick film layer with fluid flow channels and nozzle holes formed in a nozzle plate material for at least one array of fluid ejection actuators. As a result of embodiments, fluid ejector arrays of different ejection volumes may be included on a single ejection head. For example, an ink ejection head may include ejection actuators for black ink that eject about four times the volume of ink ejected from cyan, magenta, and yellow ejection actuators on the same ejection head. Another advantage is that an ejection head having two different size ejection actuator arrays for a single fluid may be provided with a single fluid source without deleteriously affecting the fluid flow to the two actuator arrays. Such advantages are not easily provided by conventional ejection heads and fabrication methods.

BRIEF DESCRIPTION OF THE DRAWINGS

Further advantages of the embodiments may be better understood by reference to the detailed description when considered in conjunction with the figures, which are not to scale and which are provided to illustrate the principle features described herein. In the drawings, like reference numbers indicate like elements through the several views.

DETAILED DESCRIPTION OF THE EMBODIMENTS

Figure 1:
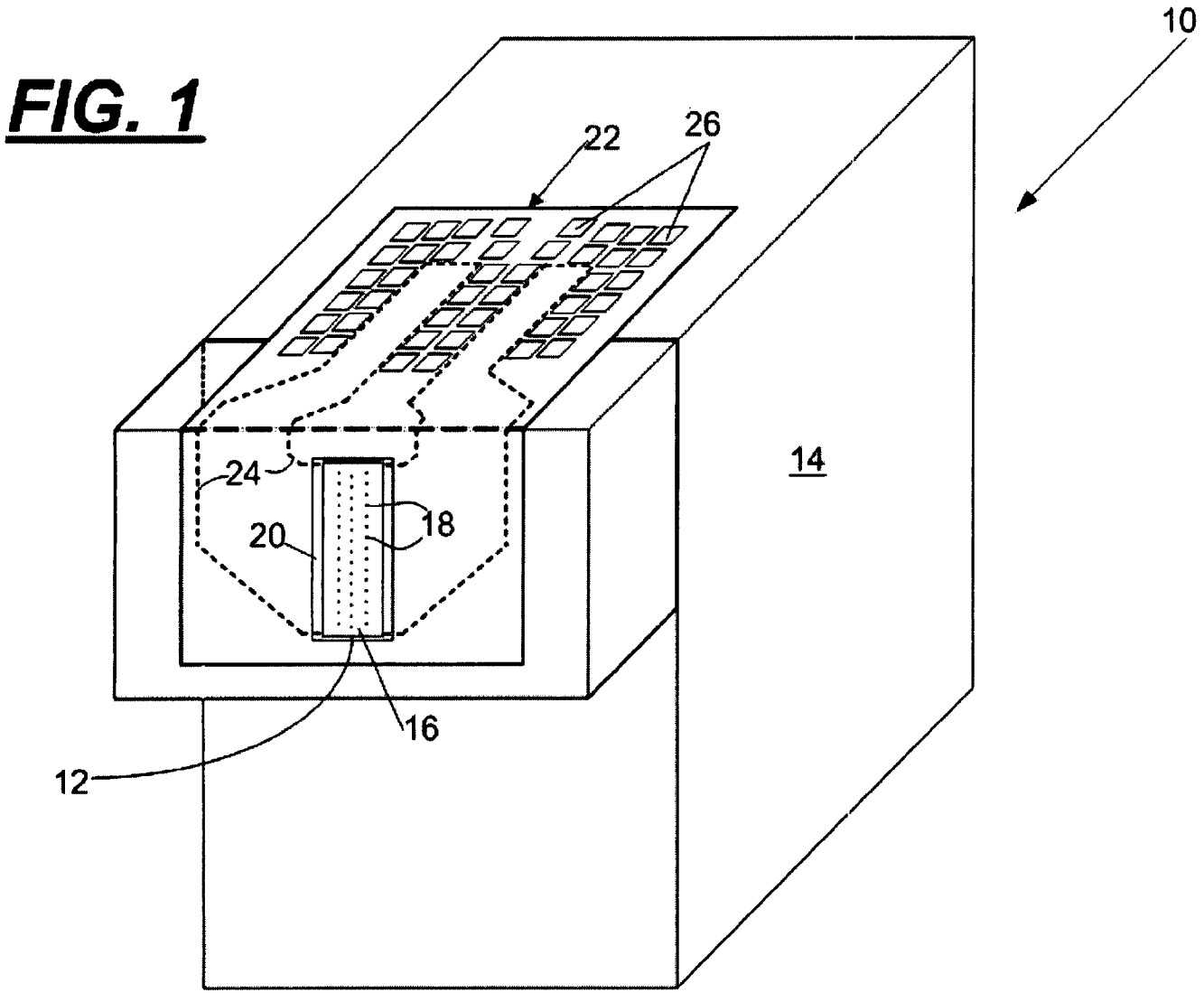
FIG. 1 is a perspective view, not to scale, of a fluid cartridge and micro-fluid ejection head according to the invention.

With reference to FIG. 1, a fluid supply cartridge 10 for use with a device such as an ink jet printer includes a micro-fluid ejection head 12 fixedly attached to a fluid supply container 14, as shown in FIG. 1, or removably attached to a fluid supply container either adjacent to the ejection head 12 or remote from the ejection head 12. In order to simplify the description, reference may be made to inks and ink jet printheads. However, the invention is adaptable to a wide variety of micro-fluid ejecting devices other than for use in ink jet printers and thus is not intended to be limited to ink jet printers.

The ejection head 12 preferably contains a nozzle plate 16 containing a plurality of nozzle holes 18 each of which are in fluid flow communication with a fluid in the supply container 14. The nozzle plate 16 is preferably made of an ink resistant, durable material such as polyimide and is attached to a semiconductor substrate 20 that contains fluid ejection actuators as described in more detail below. The semiconductor substrate 20 is preferably a silicon semiconductor substrate.

Fluid ejection actuators on the semiconductor substrate 20 are activated by providing an electrical signal from a controller to the ejection head 12. The controller is preferably provided in a device to which the supply container 14 is attached, such as an ink jet printer. The semiconductor substrate 20 is electrically coupled to a flexible circuit or TAB circuit 22 using a TAB bonder or wires to connect electrical traces 24 on the flexible or TAB circuit 22 with connection pads on the semiconductor substrate 20. Contact pads 26 on the flexible circuit or TAB circuit 22 provide electrical connection to the controller in the printer for activating the fluid ejection actuators on the ejection head 12.

During a fluid ejection operation such as printing with an ink, an electrical impulse is provided from the controller to activate one or more of the fluid ejection actuators on the ejection head 12 thereby forcing fluid through the nozzles holes 18 toward a media. Fluid is caused to refill ink chambers in the ejection head 12 by capillary action between actuator activation. The fluid flows from a fluid supply in container 14 to the ejection head 12.

It will be appreciated that micro-fluid ejection devices such as ink jet printers continue to be improved to provide higher quality images. Such improvements include increasing the number of nozzle holes 18 and ejection actuators on a semiconductor substrate 20, reducing the size of the nozzle holes 18 and substrate 20, and increasing the frequency of operation of the ejection actuators.

Figure 2:
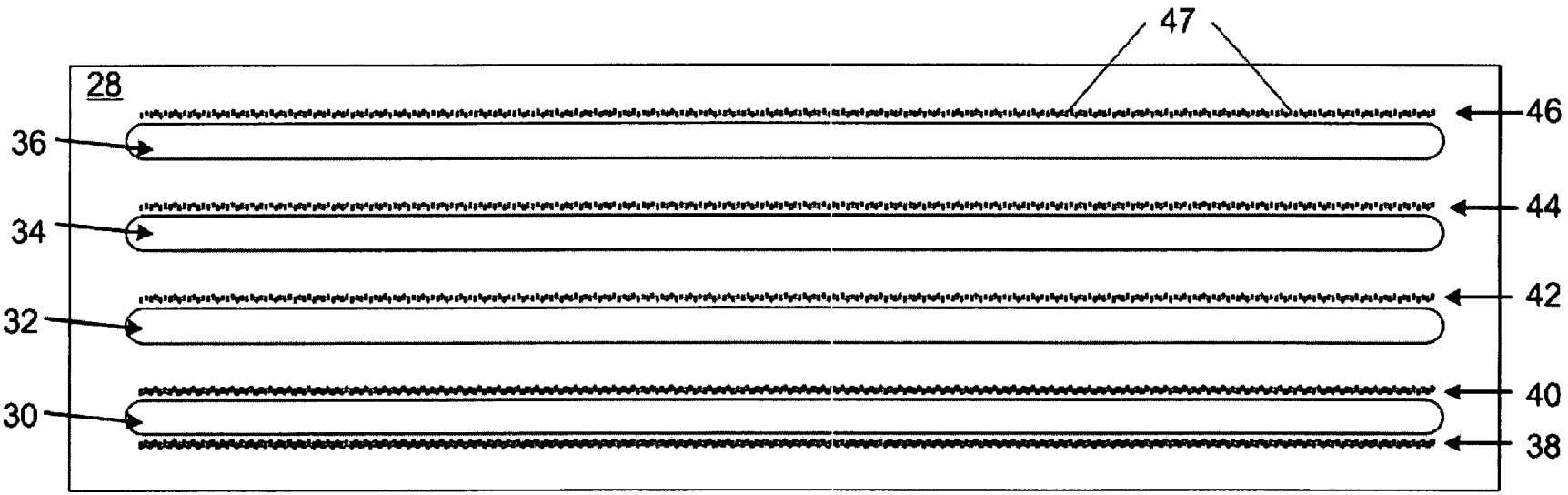
FIG. 2 is plan view, not to scale, of a semiconductor substrate containing multiple arrays of fluid ejection actuators adjacent fluid supply slots.

One improvement includes providing an ejection head capable of ejecting multiple different fluids. Such an ejection head is provided by a substrate 28 containing multiple fluid supply slots 30, 32, 34, and 36 (FIG. 2) and corresponding arrays 38, 40, 42, 44, and 46 of fluid ejection actuators 47. An "array" of fluid ejection actuators is defined as a substantially linear plurality of actuators 47 adjacent one or both sides of a fluid supply slot 30, 32, 34, or 36.

The frequency of fluid ejection from each of the arrays 38–46 depends on fluid flow characteristics of an ejection head containing the substrate 28. For example, the operational frequency of fluid ejection from each nozzle in a nozzle plate is limited by the time required to replenish fluid to a fluid chamber adjacent the fluid actuator 47. Fluid refill times are affected by the flow feature dimensions of the ejection head.

Figure 3:
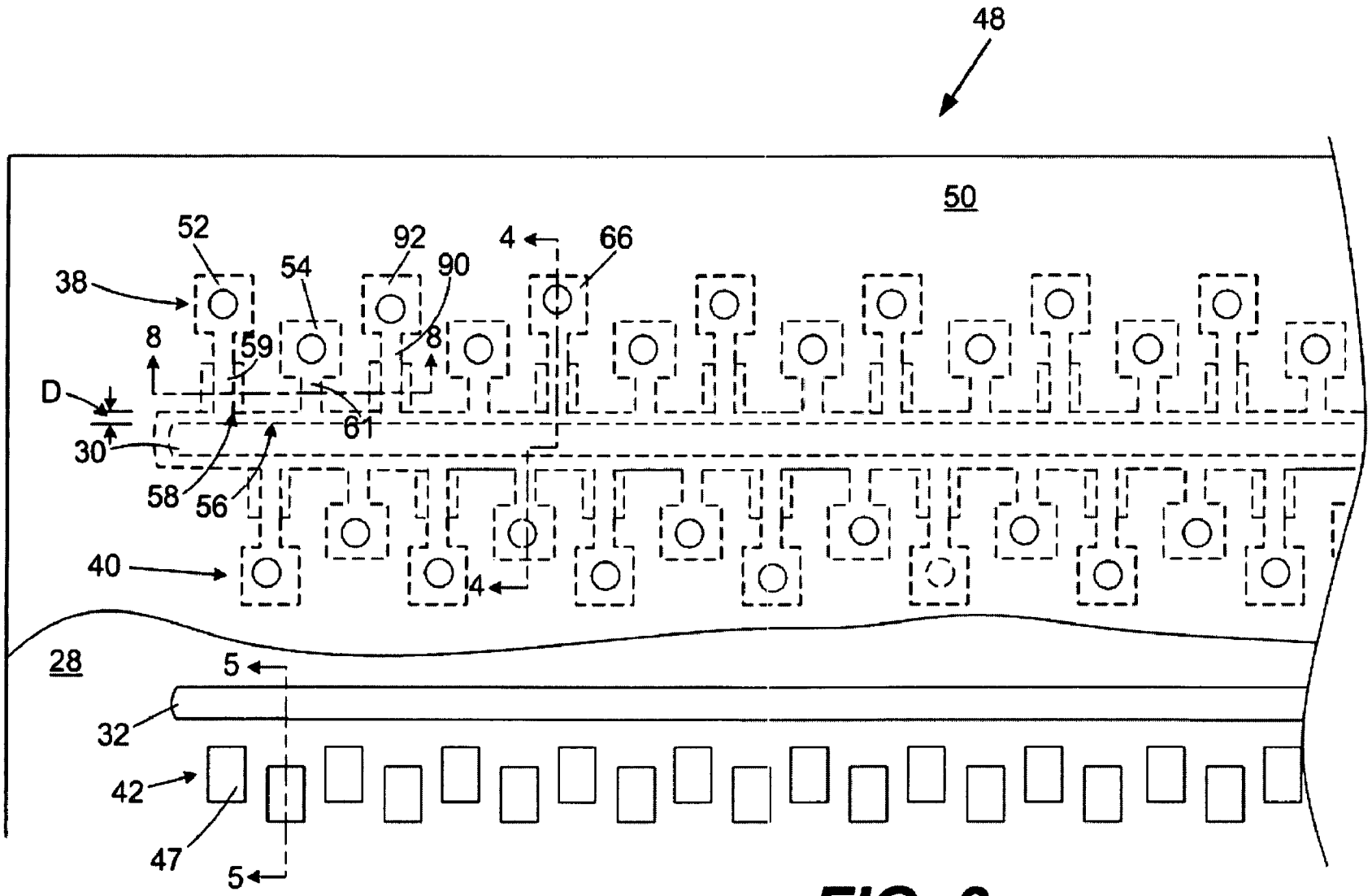
FIG. 3 is plan view, not to scale, of a portion of a micro-fluid ejection head structure according to the disclosure.
Figure 6:
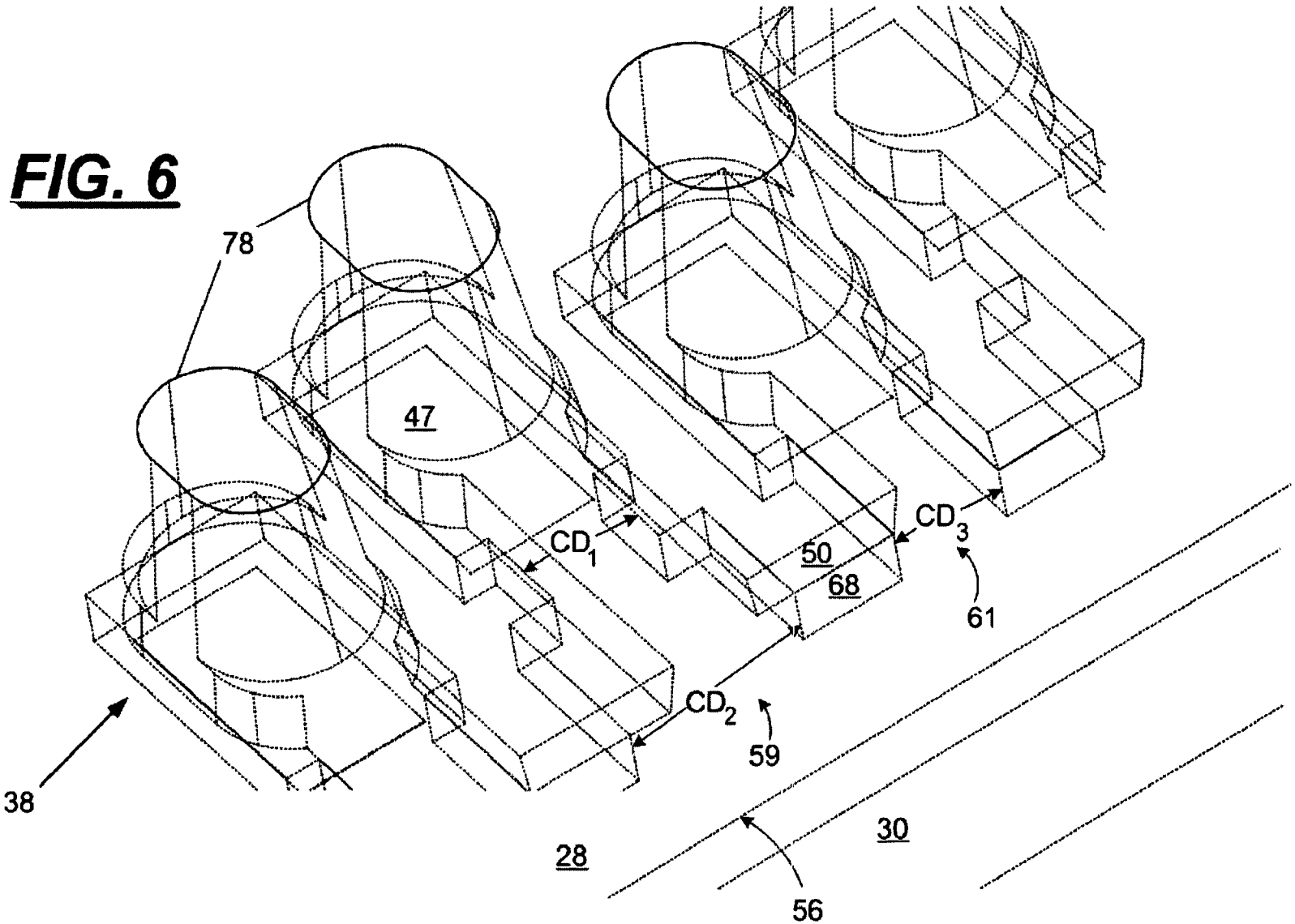
FIGS. 6 and 7 are perspective views, not to scale, of portion of a micro-fluid ejection head according to disclosure.

A portion of an ejection head 48 containing the substrate 28 and a nozzle plate 50 is illustrated in FIG. 3. As will be appreciated from FIG. 3, each array 38, 40, and 42 of fluid ejection actuators 47 contains a staggered array of actuators 47. Accordingly, adjacent fluid chambers, such as chambers 52 and 54 are disposed a different distance from the fluid supply slot 30. Accordingly, the length of fluid supply channels 59 and 61 for adjacent fluid chambers 52 and 54 is different thereby resulting in different fluid flow characteristics to the chambers 52 and 54. The distance D between a fluid supply slot edge 56 and an entrance 58 to the fluid flow channel 59 is referred to herein as the "shelf length." (FIGS. 3 and 6).

Figure 4:
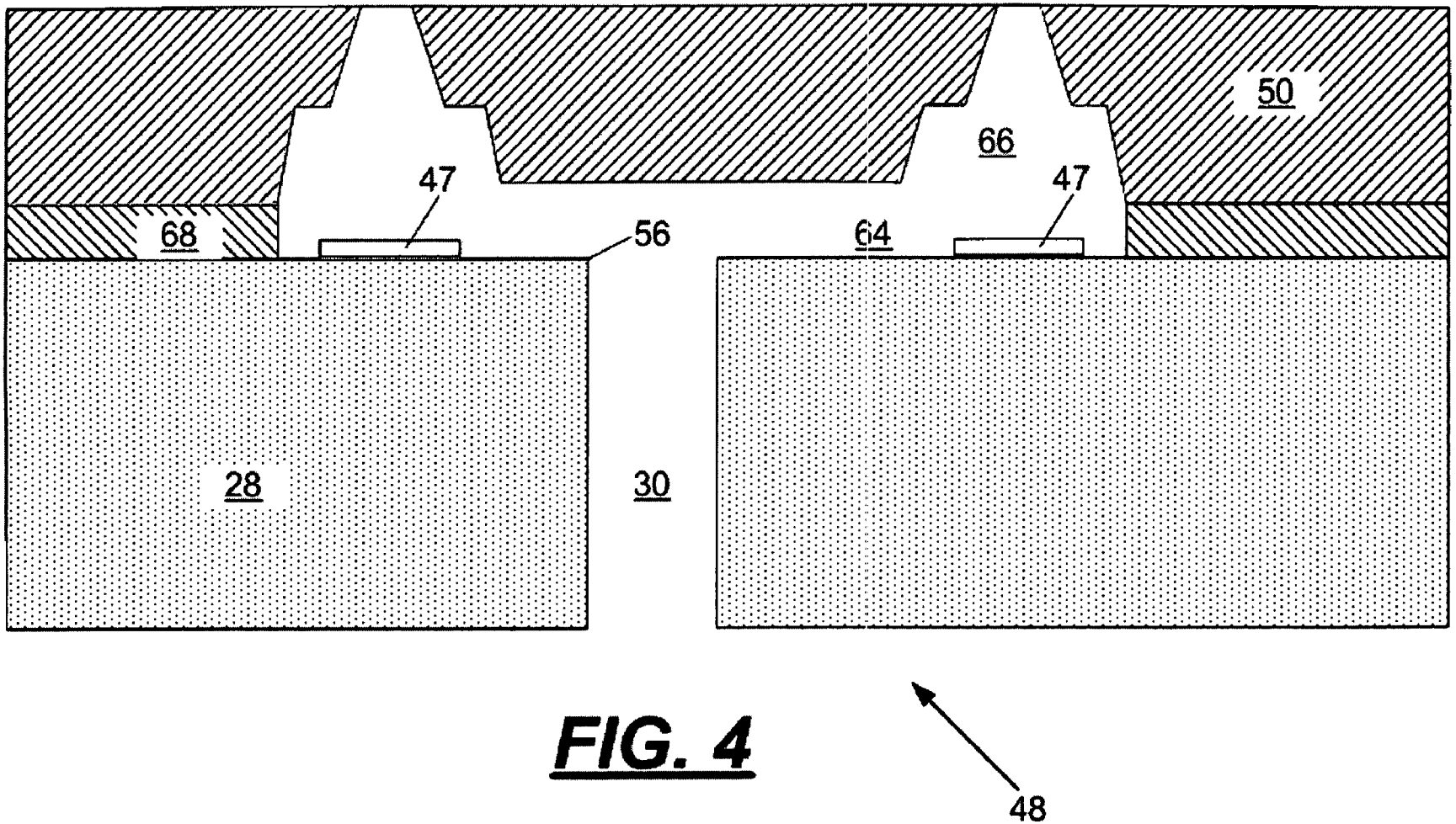
FIGS. 4 and 5 are a cross-sectional views, not to scale, of portions of a micro-fluid ejection head structure according to one embodiment of the disclosure.

A cross-sectional view, not to scale, of a portion of the ejection head 48 is illustrated in FIG. 4. The ejection head 48 includes the semiconductor substrate 28 containing fluid ejection actuators 47 disposed thereon. For simplicity, the fluid ejection actuators 47, as described herein, are thermal fluid ejection actuators. However, the embodiments of the disclosure are applicable to other types of fluid ejection actuators, including but not limited to, piezoelectric fluid ejection actuators, electrostatic ejection actuators, and the like.

Figure 5:
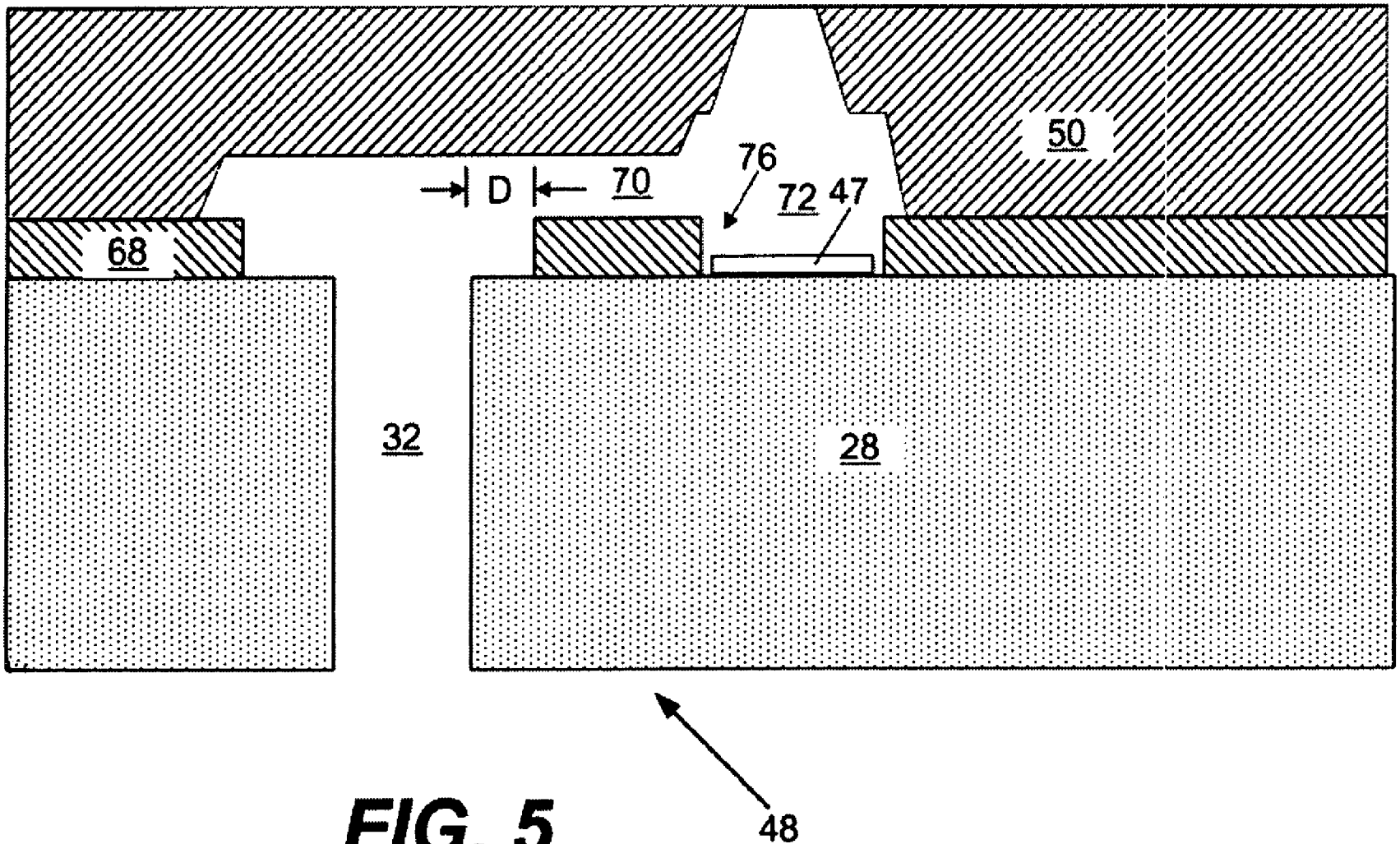

As shown in FIG. 4, a portion of the fluid flow channel 64 from the fluid supply slot 30 to a fluid chamber 66 is formed in both a thick film layer 68 and in the nozzle plate 50. In contrast, fluid flow channel 70 for ejector array 42 is formed only in the nozzle plate 50 as shown in FIG. 5. Because the thick film layer 68 does not provide a portion of the fluid flow channels 70 for ejector array 42, a fluid ejection actuator 47 is disposed in a recessed area 76 of the thick film layer 68. The recessed actuator 47 may be referred to herein as a "tub actuator" as the actuator is essentially surrounded by the thick film layer 68.

The flow features formed in the nozzle plate 50 may be formed as by laser ablating the nozzle plate material. Typically, the nozzle plate 50 is made of a polyimide material that is readily laser ablatable. Materials suitable for nozzle plate 56 according to the invention are generally available in thicknesses ranging from about 10 to about 70 microns. Commercially available nozzle plate materials have thicknesses of 25.4 microns, 27.9 microns, 38.1 microns, or 63.5 microns. Of the total thickness of the nozzle plate material, 2.54 or 12.7 microns may include an adhesive layer that is applied by the manufacturer to the nozzle plate material. It will be understood however, that the invention is also applicable to a nozzle plate material that is provided absent the adhesive layer. In this case, an adhesive may be applied separately to attach the nozzle plate 50 to the thick film layer 68.

The flow features may be formed in the thick film layer 68 as by a photolithographic technique. Typically, the thick film layer 68 is made of a photoresist material, either positive or negative photoresist, that is spin coated onto the substrate 28. In FIGS. 4 and 5, a single thick film layer 68 is illustrated. However, the thick film layer 68 may include a photoresist planarizing layer having a thickness ranging from about 0.5 to about 5.0 microns and a separate thick film layer having a thickness ranging from about 5 to about 15 microns.

Figure 7:
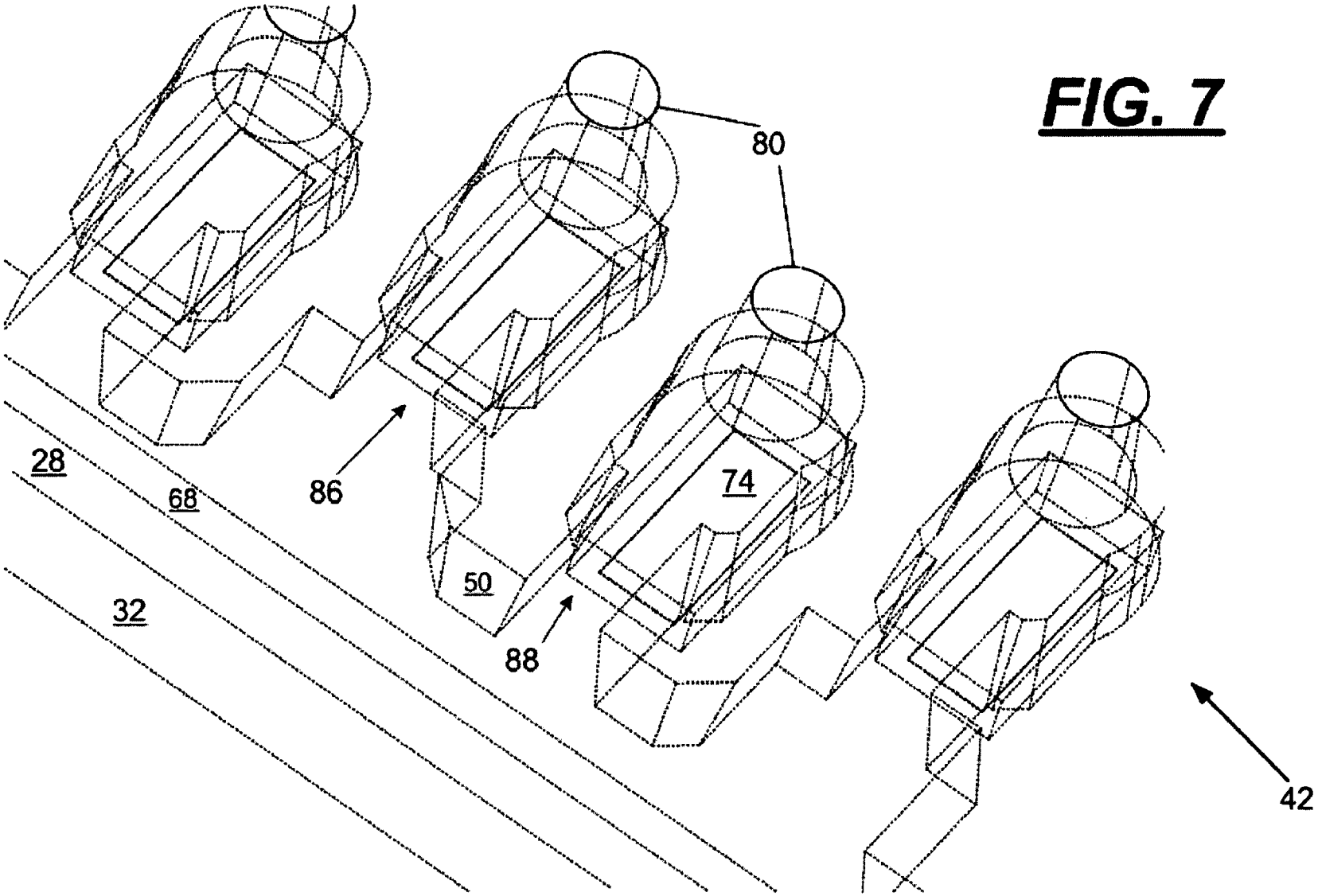

A perspective view of arrays 38 and 42 is illustrated in FIGS. 6–7. As shown in FIG. 6, array 38 includes nozzle holes 78 that are substantially larger than nozzle holes 80, FIG. 7. Accordingly, arrays 38 and 40 are configured for ejecting a larger volume of fluid, for example from about 15 to about 35 nanograms of fluid, as opposed to array 42 that is designed to eject from about 1 to about 8 nanograms of fluid.

Having a single ejection head 48 containing multiple size fluid ejection actuators 47 and nozzle holes 78 and 80 provides increased versatility for use of the ejection head 48. For example, a multi-color ink jet printhead may include the ejection head 48, wherein black, cyan, magenta, and yellow inks are ejected from the ejection head 48. Each of the inks may have a different flow characteristic or volume requirement which may be achieved by variation in the fluid flow feature design of the ejection head 48 for each of the inks.

As will be further appreciated, providing a suitable thick film layer 68 and ablatable nozzle plate 50 enables tuning fluid flow characteristics for more efficient fluid ejection at higher frequencies. In embodiments described herein, the flow features for the fluid ejection arrays 38–46 are relatively independent of either of the thickness of the thick film layer 68 or of the thickness of the nozzle plate 50.

Variations in the flow feature dimensions between adjacent fluid flow channels 59 and 61 enable tuning of fluid flow to the fluid chambers 52 and 54. For example, even though fluid chamber 52 is relatively further away from the fluid supply slot 30 than fluid chamber 54, refill times for the fluid chambers 52 and 54 can be made similar by varying certain dimensions of the fluid flow channels 59 and 61 as herein described. With reference of FIGS. 8 and 9, fluid flow channel 59 includes a choke dimension $CD_1$ and an inlet channel dimension $CD_2$. A length $L_1$ of the channel 59 having choke dimension $CD_1$ is selected so that the fluid flow characteristics to chamber 52 are similar to the fluid flow characteristics to chamber 54. In this case, chamber 54 has fluid flow channel 61 having a length $L_2$ and a choke dimension $CD_3$. However, channel 61 may have a choke dimension $CD_3$ that is the same or different from choke dimension $CD_1$ depending on the length $L_2$ of the channel 61. In this case, inlet channel dimension $CD_2$ for channel 59 is made as large as possible so as to avoid restricting the flow to channel 59.

Figure 8:
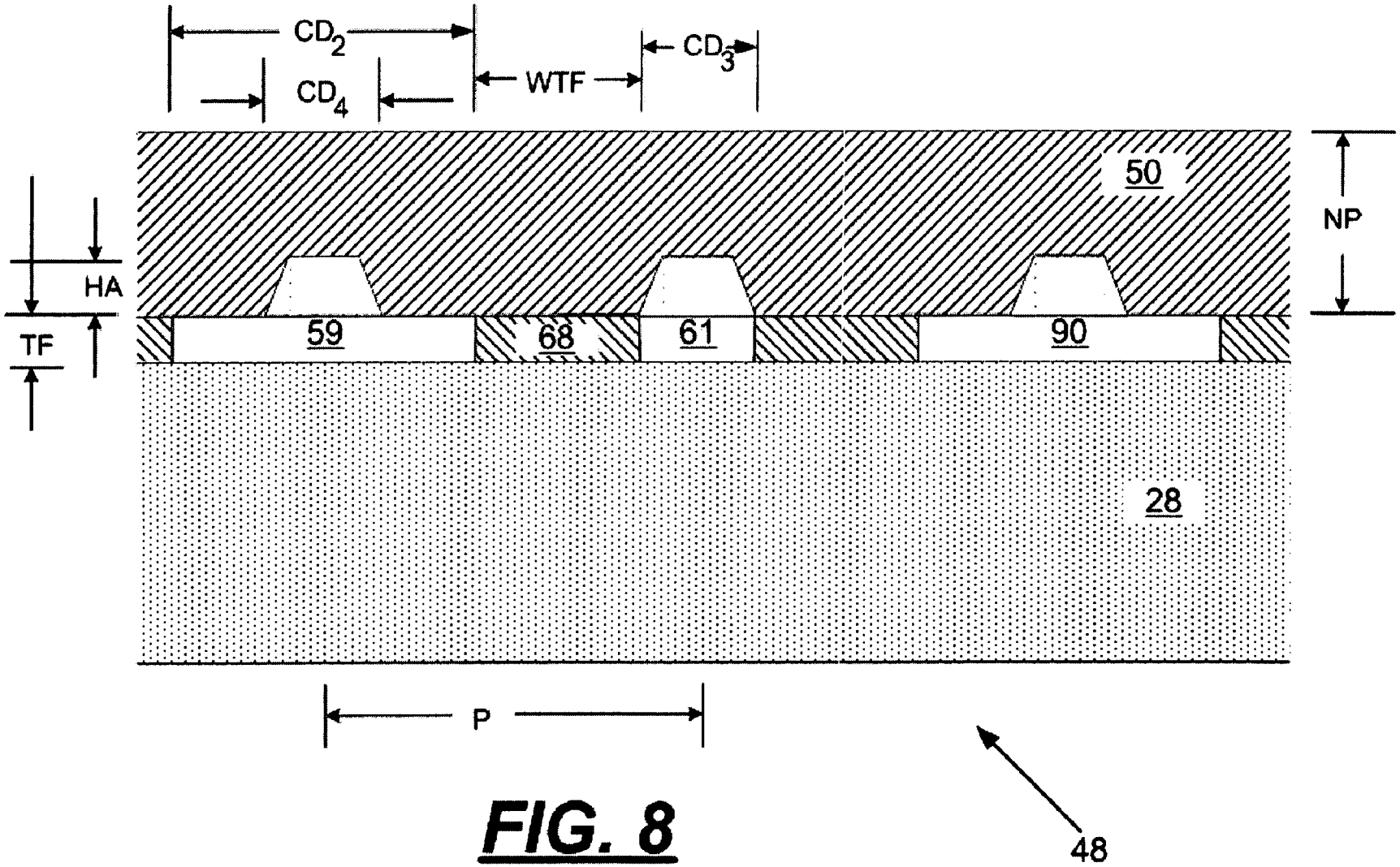
FIG. 8 is a cross-sectional view, not to scale, of a portion of fluid flow channels for a micro-fluid ejection head structure according to the disclosure.

The foregoing modification of the fluid flow channel 59 is possible because the fluid flow channel 59 is formed in both the thick film 68 and in the nozzle plate 50. By contrast, the fluid flow channels 86 and 88 for nozzle holes 80 are formed only in the nozzle plate 50. FIG. 8 is a cross-sectional view, not to scale, of a portion of the fluid flow channels 59, 61, and 90 for fluid chambers 52, 54, and 92 (FIG. 3). As illustrated in FIG. 8, fluid flow channels 59, 61, and 90 are formed in both the thick film layer 68 and in the nozzle plate 50. However, fluid flow channels 59 and 90 have an increased inlet channel dimension $CD_2$ provided in the thick film layer 68.

For further clarification, let $CD_4$ (FIG. 8) be the width of the ablated region of the fluid flow channel 59 in the nozzle plate 50. $CD_2$ is the width of the inlet channel dimension for fluid flow channel 59, $CD_1$ is the width of the choke region of the fluid flow channel 59, and $CD_3$ is the width of the choke region of the fluid flow channel 61 in the thick film layer 68. The depth or height of the ablated region of the fluid flow channels 59 and 61 in the nozzle plate 50 is HA. The thickness of the thick film layer is TF. The center to center spacing between adjacent fluid flow channels 59 and 61 is the pitch P. Accordingly, the width WTF of a thick film layer 68 wall remaining between fluid flow channels 59 and 61 is defined by $P-(\frac{1}{2}CD_2+\frac{1}{2}CD_3)=WTF$.

To assure the most robust adhesion of the thick film layer 68 to the substrate 28, it is desirable to size $CD_2$ such that WTF is greater than or equal to TF, where WTF is at least about 12 microns.

Figure 9:
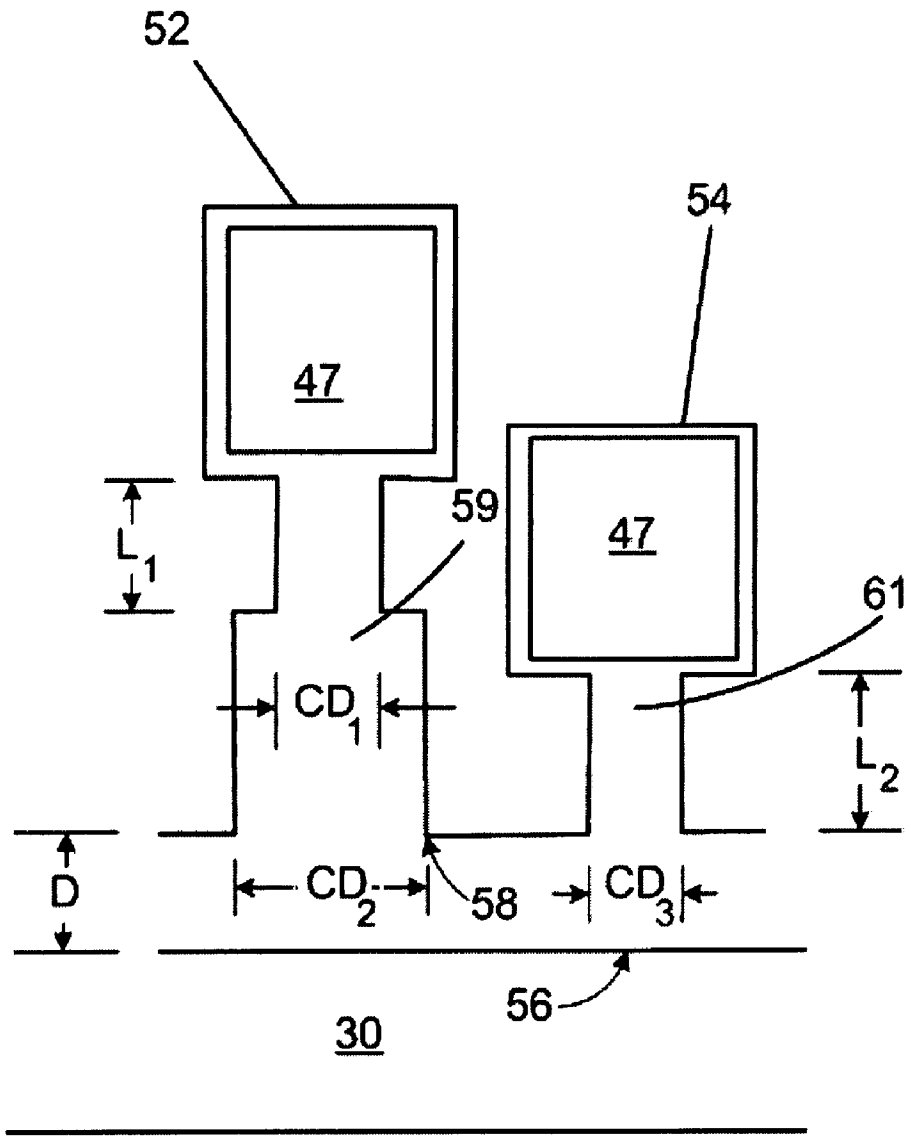
FIG. 9 is a plan view, not to scale, of a portion of a thick film layer containing fluid chambers and fluid flow channels for adjacent fluid ejectors.

With regard to the above relationships, a comparison of the dimensions for ejector arrays 38 and 42 with reference to FIGS. 8 and 9 is provided by way of the following non-limiting example.

| Dimensions (Nozzle Plate 50 and Thick film layer 68) | Ejector Array 38 (microns) | Ejector Array 42 (microns) |
|---|---|---|
| Thick Film thickness (TF) | 9 | 9 |
| Nozzle Plate Thickness (NP) | 38.1 | 38.1 |
| Nozzle Plate Ablation Depth (HA) | 9 | 18 |
| Nozzle Bore Length | 29.1 | 20.1 |
| Thick Film Choke Length ($L_1$) | 16 | None |
| Thick Film Choke Length ($L_2$) | 22 | None |
| Thick Film Choke Width ($CD_1$) | 18 | None |
| Thick Film Channel Inlet Width ($CD_2$) | 35 | None |
| Thick Film Choke Width ($CD_3$) | 18 | None |
| Nozzle Plate Choke Width ($CD_4$) | 18 | 16 |
| Nozzle Plate Choke Length (near nozzle) | 22 | 22 |
| Nozzle Plate Choke Length (far nozzle) | 16 | 16 |
| Nozzle Plate Channel Inlet Width | 35 | 35 |

In order to provide similar flow characteristics for chambers 52 and 54 in ejector arrays 38 and 40 (FIGS. 8 and 9), the following dimensions are provided, by way of example only and are not intended to limit the embodiments described herein in any material way.

| Dimensions | Flow Channel 59 (microns) | Flow Channel 61 (microns) |
|---|---|---|
| Thick Film Thickness (TF) | 9 | 9 |
| Nozzle Plate Ablation Depth (HA) | 9 | 9 |
| Thick Film Choke Length (L) | 16 ($L_1$) | 22 ($L_2$) |
| Thick Film Choke Width (CD) | 18 ($CD_1$) | 18 ($CD_3$) |
| Thick Film Channel Entrance ($CD_2$) | 35 | 18 |
| Pitch (P) | 42.3 | |
| Thick Film Wall (WTF) | 15.8 | |
| Flow resistance ratio (flow channels 61 to 59) | 0.998 | |

For flow channels 59 and 61, the resistance of each channel is substantially the same as evidenced by the flow resistance ratio of about 1.0. Accordingly, the ejected mass of fluid from each channel 59 and 61 is approximately the same. It will be appreciated that the thick film layer 68 thickness (TF) may be decreased by increasing the choke widths ($CD_1$ and $CD_3$) for the channels and/or decreasing the choke lengths ($L_1$ and $L_2$). A reduced choke length ($L_1$ and $L_2$) enables use of a narrower substrate 28, thereby reducing the cost of a substrate 28 containing multiple fluid supply slots 30–36 for multiple fluids. However, the flow resistance of adjacent fluid flow channels 59 and 6*i* can be made substantially the same by varying the choke widths ($CD_1$ and $CD_3$) in the thick film layer 68 to provide equivalent jetting performance for the adjacent fluid chambers 52 and 54. Furthermore, an ejection head 48 for ejecting different volumes of different fluids may be provided using a combination of the thick film layer 68 of minimum thickness and the nozzle plate 50 wherein the fluid flow channels may be specifically configured for each array of fluid ejection actuators 38–46.

Having described various aspects and embodiments of the disclosure and several advantages thereof, it will be recognized by those of ordinary skills that the embodiments described herein are susceptible to various modifications, substitutions and revisions within the spirit and scope of the appended claims.

What is claimed is:

1. A micro-fluid ejection head structure comprising:

a substrate having a first array of fluid ejection actuators for ejecting a first fluid therefrom, and a second array of fluid ejection actuators for ejecting a second fluid therefrom;

a thick film layer having a thickness attached adjacent the substrate, the thick film layer having fluid flow channels formed therein for all of the first array of fluid ejection actuators and not for any of the second array of fluid ejection actuators; and a nozzle plate attached to the thick film layer opposite the substrate, the nozzle plate having fluid flow channels formed therein for both the first array of fluid ejection actuators and the second array of fluid ejection actuators.

2. The micro-fluid ejection head structure of claim 1, further comprising a third array of fluid ejection actuators disposed in a third location on the substrate, wherein the nozzle plate has fluid flow channels formed therein for the third array of fluid ejection actuators.

3. The micro-fluid ejection head structure of claim 2, further comprising a fourth array of fluid ejection actuators disposed in a fourth location on the substrate, wherein the nozzle plate has fluid flow channels formed therein for the fourth array of fluid ejection actuators.

4. The micro-fluid ejection head structure of claim 1, wherein the fluid ejection actuators comprise thermal fluid ejection actuators.

5. A multi-color printhead comprising the micro-fluid ejection head structure of claim 1.

6. An ink jet printer comprising the multi-color printhead of claim 5.

7. A micro-fluid election head structure comprising:

a semiconductor substrate having a first array of fluid ejection actuators for ejecting a first fluid therefrom, the first array of fluid ejection actuators being disposed in a first location on the substrate, and at least a second array of fluid ejection actuators for ejecting a second fluid therefrom, the second array of fluid ejection actuators being disposed in a second location on the substrate;

a thick film layer having a thickness attached adjacent the semiconductor substrate, the thick film layer having fluid flow channels formed therein solely for the first array of fluid ejection actuators; and a nozzle plate attached to the thick film layer opposite the semiconductor substrate, the nozzle plate having fluid flow channels formed therein for both the first array of fluid ejection actuators and the second array of fluid ejection actuators, wherein the fluid flow channels include a fluid throat, wherein the fluid throat has a width in the thick film layer that is at least as wide as a fluid throat width in the nozzle plate.

8. The micro-fluid ejection head structure of claim 7, further comprising a width of thick film layer between adjacent fluid throats that is equal to or greater than the thickness of the thick film layer.

9. The micro-fluid ejection head structure of claim 8, wherein the width of thick film layer between adjacent fluid throats is at least about 6 microns wide.

10. The micro-fluid ejection head structure of claim 8, wherein the thickness of the thick film layer ranges from about 5 microns to about 15 microns.

11. A micro-fluid ejection head structure comprising:

a substrate having a first array of fluid ejection actuators for ejecting a first fluid therefrom, and a second array of fluid ejection actuators for ejecting a second fluid therefrom;

a thick film layer having a thickness attached adjacent the substrate, the thick film layer having fluid flow channels of a first height formed therein for the first array of fluid ejection actuators and having fluid flow channels of a second height formed therein for the second array of fluid ejection actuators, wherein the second height is different from the first height; and a nozzle plate attached to the thick film layers opposite the substrate, the nozzle plate having fluid flow channels formed therein for both the first array of fluid ejection actuators and the second array of fluid ejection actuators.

12. The micro-fluid ejection head structure of claim 11, further comprising a third array of fluid ejection actuators disposed in a third location on the substrate, wherein the nozzle plate has fluid flow channels formed therein for the third array of fluid ejection actuators.

13. The micro-fluid ejection head structure of claim 12, further comprising a fourth array of fluid ejection actuators disposed in a fourth location on the substrate, wherein the nozzle plate has fluid flow channels formed therein for the fourth array of fluid ejection actuators.

14. The micro-fluid ejection head structure of claim 11, wherein the second array of fluid ejection actuators comprises ink chambers recessed in the thick film layer.

15. A multi-color printhead comprising the micro-fluid ejection head structure of claim 11.

16. A micro-fluid ejection head structure comprising:

a semiconductor substrate having a first array of fluid ejection actuators for ejecting a first fluid therefrom, the first array of fluid ejection actuators being disposed in a first location on the substrate, and at least a second array of fluid ejection actuators for ejecting a second fluid therefrom, the second array of fluid ejection actuators being disposed in a second location on the substrate;

a thick film layer having a thickness attached adjacent the semiconductor substrate and first array of fluid ejection actuators, the thick film layer having fluid flow channels of a first height formed therein for the first array of fluid ejection actuators and having fluid flow channels of a second height formed therein for the second array of fluid ejection actuators, wherein the second height ranges from about 0 to about the thickness of the thick film layer; and a nozzle plate attached to the first and second thick film layers opposite the semiconductor substrate, the nozzle plate having fluid flow channels formed therein for both the first array of fluid ejection actuators and the second array of fluid ejection actuators, wherein the fluid flow channels include a fluid throat, wherein the fluid throat has a width in the thick film layer that is at least as wide as a fluid throat width in the nozzle plate.

17. The micro-fluid ejection head structure of claim 16, further comprising a width of thick film layer between adjacent fluid throats that is equal to or greater than the thickness of the thick film layer.

18. The micro-fluid ejection head structure of claim 17, wherein the width of thick film layer between adjacent fluid throats is at least about 6 microns wide.

19. The micro-fluid ejection head structure of claim 17, wherein the thickness of the thick film layer ranges from about 5 microns to about 15 microns.

* * * * *